US005570809A

United States Patent [19]

Martin

[11] Patent Number: 5,570,809

[45] Date of Patent: Nov. 5, 1996

[54] ADHESIVE LABEL DISPENSER

[76] Inventor: Rodger D. Martin, 5979 W. 950 N., Thorntown, Ind. 46071

[21] Appl. No.: 390,088

[22] Filed: Feb. 17, 1995

[51] Int. Cl.[6] ..... B65H 5/28; G07F 11/68

[52] U.S. Cl. ..... 221/73; 221/70; 221/102; 221/283; 221/284

[58] Field of Search ..... 221/73, 70, 2, 221/102, 97, 283, 284; 206/390, 408, 412; 271/8.1

[56] References Cited

U.S. PATENT DOCUMENTS

| | | | |
|---|---|---|---|
| 2,257,584 | 9/1941 | Wyllie | 221/283 X |
| 2,276,296 | 3/1942 | Flood | 206/58 |
| 2,341,368 | 2/1944 | Flood | 206/58 |
| 2,372,245 | 3/1945 | Avery | 206/58 |
| 2,373,092 | 4/1945 | Avery | 206/58 |
| 2,419,809 | 4/1947 | Avery | 312/91 |
| 2,912,140 | 11/1959 | Cole | 221/73 |
| 3,128,012 | 4/1964 | Berg | 221/70 |
| 3,231,130 | 1/1966 | Foote | 221/70 |
| 3,514,016 | 5/1970 | Hackney | 221/70 |
| 3,698,600 | 10/1972 | Foote | 221/70 |
| 4,024,011 | 5/1977 | Crankshaw et al. | 221/73 X |
| 4,059,203 | 11/1977 | Wright | 221/73 |
| 4,094,438 | 6/1978 | Neubauer | 206/390 X |
| 4,162,739 | 7/1979 | Nelson | 221/70 |
| 4,173,293 | 11/1979 | Hamisch, Jr. et al. | 206/390 X |
| 4,807,753 | 2/1989 | Goldstein | 206/390 |
| 5,065,896 | 11/1991 | Jurgich | 221/73 |
| 5,449,090 | 9/1995 | Rodriguez | 221/73 |

*Primary Examiner*—H. Grant Skaggs
*Assistant Examiner*—Dean A. Reichard
*Attorney, Agent, or Firm*—Woodard, Emhardt, Naughton Moriarty & McNett

[57] ABSTRACT

An adhesive label dispenser which can accommodate multiple rolls, which allows for easy substitution of rolls without disassembly of the device, and which eliminates the need for continuous removal and disposal of the used backing paper.

18 Claims, 5 Drawing Sheets

ADHESIVE LABEL DISPENSER

TECHNICAL FIELD OF THE INVENTION

The present invention relates to adhesive label dispensers.

BACKGROUND OF THE INVENTION

In the art of adhesive labels, it is known to provide a plurality of adhesive labels releasably adhered to a strip of backing paper, such as a wax paper. The backing paper is provided in the form of a roll. Devices have been designed in the prior art to contain such rolls and to separate the labels from the backing paper when the backing paper is pulled from the container.

For example, U.S. Pat. No. 2,373,092 to Avery discloses a label and tape dispensing machine which holds a roll of adhesive labels which are attached to a strip of backing paper. The backing paper is wrapped 180° around a metal edge. When the backing paper is pulled across this metal edge, the labels become separated from the backing paper at the edge, flip over, and are deposited on a sandpaper surface.

There have also been attempts in the prior art to provide label dispensers which are capable of dispensing labels from a plurality of different rolls. For example, U.S. Pat. No. 3,231,130 to Foote discloses a label dispenser in which a strip of backing paper is bent around a 90° corner, causing the labels to be separated therefrom when the backing paper is pulled. Multiple rolls of labels are accommodated by providing a plurality of dividers which separate the rolls.

In all such prior art devices, however, replacing spent rolls or substituting rolls with different label designs is a fairly laborious task, in that the dispensers must be disassembled in order to remove the old roll and insert the new roll. Furthermore, the continuous dispensing of labels results in long pieces of the backing paper protruding from the dispenser, which backing paper must periodically be torn off by the user and discarded.

There is therefore a need in the prior art for a label dispenser which can accommodate multiple rolls, which allows for easy substitution of rolls without disassembly of the device, and which eliminates the need for continuous removal and disposal of the used backing paper. The present invention is directed toward meeting these needs.

SUMMARY OF THE INVENTION

The present invention relates to an adhesive label dispenser which can accommodate multiple rolls, which allows for easy substitution of rolls without disassembly of the device, and which eliminates the need for continuous removal and disposal of the used backing paper.

In one form of the invention an adhesive label dispenser is disclosed, comprising a first end wall; a second end wall spaced from the first end wall; first and second longitudinally extending members positioned between the first and second end walls so as to form a longitudinally extending trough having an open bottom channel, the trough thereby being adapted to hold a plurality of rolls of backing paper which carry adhesive labels thereon; a longitudinally extending divider rod positioned between the first and second end walls and adjacent to the bottom channel; and at least one divider shaped to fit within the trough when positioned transverse to the trough, the divider including means for slidably engaging the divider rod.

In another form of the invention an adhesive label dispenser is disclosed, comprising a first end wall; a second end wall spaced from the first end wall; first and second longitudinally extending members positioned between the first and second end walls so as to form a longitudinally extending trough adapted to hold at least one roll of backing paper which carries adhesive labels thereon; and a trash receptacle coupled to the first and second end walls, the trash receptacle having an opening positioned such that the backing paper may be fed into the opening after the labels have been removed therefrom.

In another form of the invention an adhesive label dispenser is disclosed, comprising a first end wall; a second end wall spaced from the first end wall; a roll holder positioned between the first and second end walls and adapted to hold at least one roll of backing paper which carries adhesive labels thereon; a first longitudinally extending threading rod positioned between the first and second end walls; a second longitudinally extending threading rod positioned between the first and second end walls; and a longitudinally extending separating bar having two legs and an L-shaped cross-section, the separating bar positioned between the first and second end walls, wherein the separating bar lies between the first and second threading rods such that the first threading rod is positioned substantially between the legs of the separating bar. In another form of the invention an adhesive label dispenser cart is disclosed, comprising a plurality of vertical support members; a horizontal work surface supported by the vertical support members; an adhesive label dispenser coupled to the vertical support members; a rotating storage bin coupled to the vertical support members, wherein the rotating storage bin includes a plurality of trays; and a plurality of wheels coupled to the vertical support members, wherein the cart is supported by the plurality of wheels such that the cart may be rolled from place to place.

DESCRIPTION OF THE PREFERRED EMBODIMENT

Figure 1:
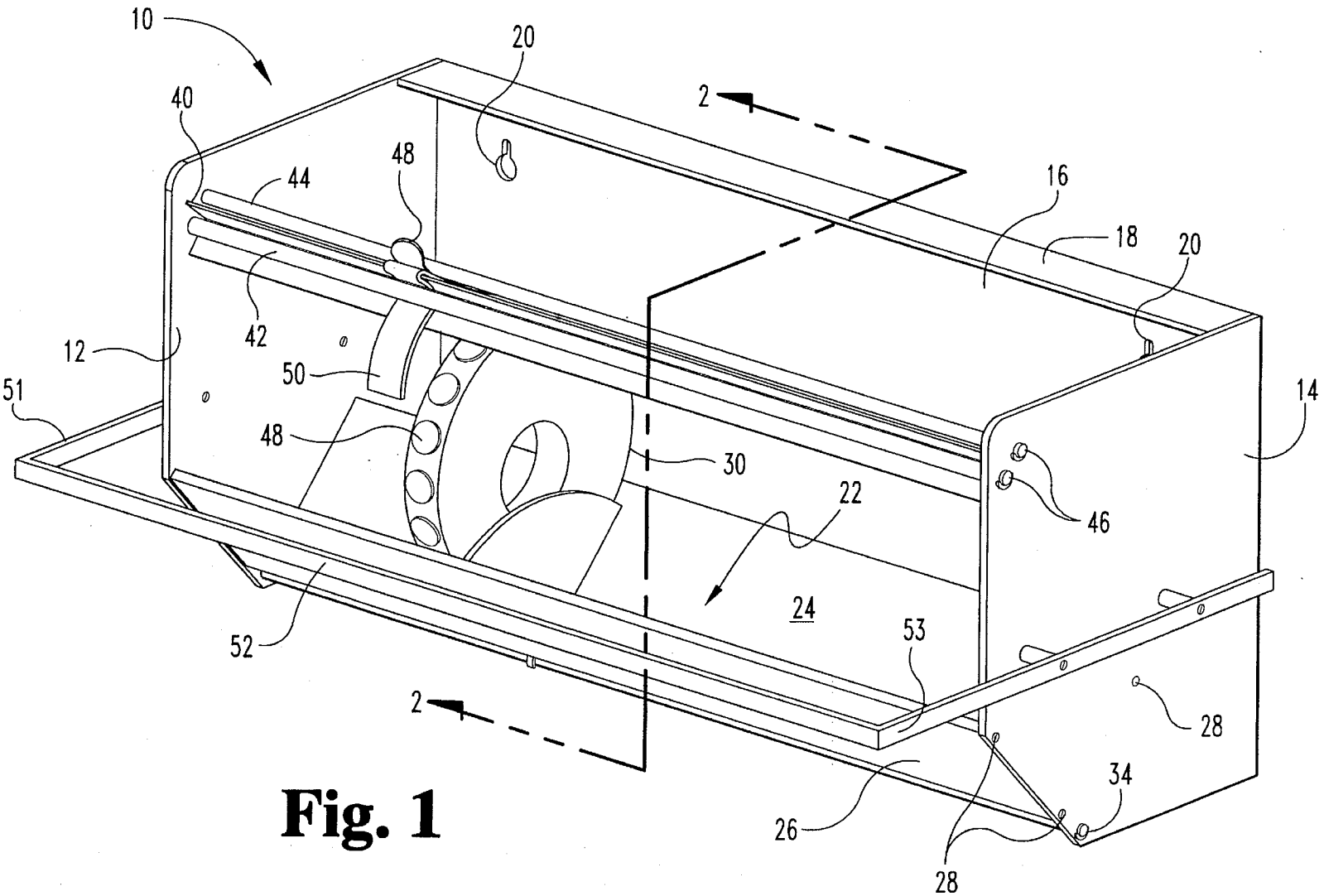
FIG. 1 is a perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a first embodiment adhesive label dispenser of the present invention, indicated generally at 10. The label dispenser 10 includes an enclosure formed on three sides thereof by the left wall 12, the right wall 14 and the rear wall 16. The rear wall 16 preferably includes an inwardly facing lip 18 formed at a top surface thereof. The portions 12–18 of the enclosure of the label dispenser 10 are preferably formed from a single piece of aluminum, which is bent into the shape illustrated in FIG. 1. The rear wall 16 includes a pair of keyed slots 20 which may be used to hang the label dispenser 10 upon a vertical surface by using two screws inserted into the vertical surface for this purpose.

An open trough 22 is formed within the enclosure by inclined members 24 and 26 which are coupled between the end walls 12 and 14. The open channel formed in the bottom of the trough 22 is more clearly visible in the cross-sectional illustration of FIG. 2. The members 24 and 26 are coupled to the end walls 12 and 14 by means of countersunk screws 28. The width of the members 24 and 26 and the interior angle formed between the members 24 and 26 is chosen such that label rolls 30 will rest therein.

Figure 2:
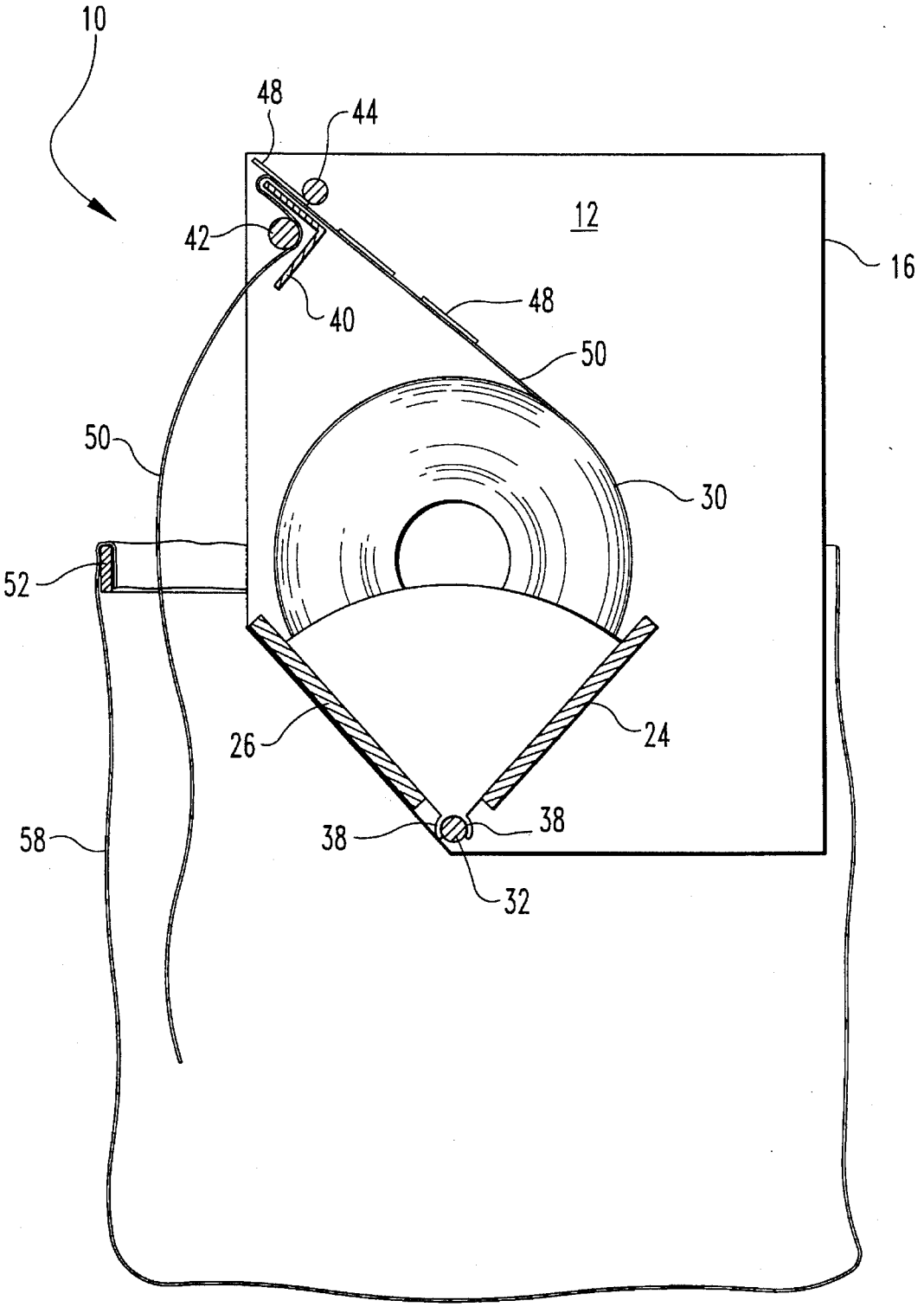
FIG. 2 is a cross-sectional view of the first embodiment of the present invention.

As best illustrated in FIG. 2, a dowel rod 32 extends between the end walls 12 and 14 and is positioned adjacent the open channel at the bottom of the trough 22. The rod 32 preferably extends through the end plates 12 and 14 and is secured by means of endcaps 34. The rod 32 is used to mount a plurality of dividers 36, which are substantially fan-shaped in order to substantially fill the space of the trough 22. The dividers 36 include finger portions 38 which extend through the open bottom channel to clip to the rod 32, thereby securely holding the divider 36 in place, but allowing the divider 36 to be removed by pulling vertically upon the divider 36 to disengage it from the rod 32. Because the divider 36 may be slid back and forth in the trough 22 while engaged upon the rod 32, label rolls 30 of varying widths may be accommodated by the label dispenser 10 by proper positioning of the dividers 36.

The label dispenser 10 further includes a substantially L-shaped separating bar 40 extending between the end walls 12 and 14. The separating bar 40 is preferably welded to the end walls 12 and 14. A first threading rod 42 extends between the end walls 12 and 14 and is positioned substantially between the arms of the separating bar 40. A second threading rod 44 also extends between the end walls 12 and 14, and is positioned adjacent the upper arm of the separating bar 40. The threading rods 42 and 44 preferably extend through the end walls 12 and 14, and are held in place by appropriate endcaps 46.

In operation, one or more label rolls 30, comprising adhesive labels 48 adhered to a strip of backing paper 50, are positioned within the trough 22 such that they are supported by the members 24 and 26, and are prevented from lateral movement by appropriately placed dividers 36. The free end of the backing paper 50 of each roll 30 is threaded between the separating bar 40 and the second threading rod 44, bent around the top edge of the separating bar 40 and then threaded between the first threading rod 42 and the bottom arm of the separating bar 40, as illustrated in FIG. 2. In this manner, the free end of the backing paper 50 is secured by the label dispenser 10, such that it is always positioned in front of and above the roll 30. In order to dispense labels, the operator simply grasps the free end of the backing paper 50 and pulls downward. The bending of the backing paper 50 around the upper edge of the separating bar 40 causes the backing paper 50 to peel away from the label 48. This occurs because the sheer strength of the adhesive between the label 48 and the backing paper 50 is less than the force required to bend the label 48 around the top of the separating bar. Therefore, the adhesive bond between the label 48 and the backing paper 50 is broken, and the label 48 extends upward, away from the backing paper 50, as the backing paper 50 is advanced. In this way, successive labels 48 are removed from the backing paper 50 and presented to the operator when the backing paper 50 is pulled in a downward direction.

It will be appreciated by those skilled in the art that the relatively open construction of the enclosure of the label dispenser 10 allows for quick and simple removal and insertion of label rolls 30. The rolls 30 are simply removed or inserted into the open trough 22 between the separating bar 40 and the top of the trough 22. No disassembly of any portion of the label dispenser 10 is required for this operation. Furthermore, rolls 30 of varying widths are easily accommodated by the label dispenser 10. A roll 30 of any width may be placed into the open trough 22 and a divider 36 may be placed next to the roll 30 and clipped in place on the divider rod 32. The next roll 30 may then be placed into the trough 22 next to the first divider 36, and a second divider 36 placed on the other side thereof. This process may be repeated until the label dispenser 10 is full. The free ends of the backing paper 50 of each of the rolls 30 are then threaded over the separating bar 40 as illustrated in FIG. 2. After these simple operations are completed, any of the labels on the rolls 30 may be quickly and easily dispensed by simply pulling down on the free end of the appropriate backing paper 50. If at any time it is desired to replace a roll 30 with a different roll, the roll 30 is easily removed from the label dispenser 10, and a new roll inserted in its place.

A further feature of the label dispenser 10 are the holding members 51, 52, and 53 which extend around three sides thereof. The holding members 51 and 53 are mounted to the end walls 12 and 14, respectively, by means of countersunk screws 54 extending through spacers 56. The holding member 52 is coupled between the members 51 and 53. The members 51–53 are provided for mounting a trash receptacle (such as a plastic trash bag) thereon, therefore the distance that the member 52 extends away from the label dispenser 10 is determined by the size of trash receptacle 58 which is desired to be mounted upon the label dispenser 10. The total circumference of the label dispenser 10 at the location of the members 51–53 should be just slightly smaller than the circumference of the opening of the trash receptacle 58. In this way, the trash receptacle 58 may be slipped over the label dispenser 10 from below, and the top edge thereof folded over the members 51–53 as illustrated in FIG. 2. In this manner, the trash receptacle 58 will be held securely in position. With the trash receptacle 58 so positioned, the free ends of the backing paper 50 of each of the rolls 30 will fall into the trash receptacle 58 as each of the rolls 30 is consumed. Because the trash receptacle 58 automatically collects the used portions of the rolls 30, it is not necessary for the operator to continuously tear off the free ends of the backing paper 50 and dispose of these free ends. Collection of the refuse produced by the label dispensing process is therefore automatically accomplished by the label dispenser 10. When the trash receptacle 58 becomes full, it is simply removed from the members 51–53 in a reverse process, and is replaced by a new trash receptacle 58.

The various components of the adhesive label dispenser 10 may be constructed from any convenient materials. For example, if the adhesive label dispenser 10 is to be used in the food service industry, such as in a meat department, then it is important that the construction materials meet the sanitary requirements of the environment of use. In such an application, it is preferred that the trough members 24 and 26 be formed from a food digradable polyboard such as that available from ASN Plastics, of Indianapolis, Ind., the screws formed from stainless steel, and the remaining components formed from aluminum.

In the first embodiment of the present invention illustrated in FIG. 1–2, the relative positioning of the separating bar 40 and the threading rods 42 and 44 causes the labels 48 to be dispensed near the top of the label dispenser 10. This positioning is preferred in certain applications, such as when the label dispenser 10 is hung on the front wall of a horizontal work surface. For example, the label dispenser 10 may be used in a butcher shop, where various types of labels must be attached to the meat after it is packaged. The packaged meat is placed onto trays on a horizontal work surface that is positioned approximately at the height of the operator's chest. The label dispenser 10 is positioned on the front vertical wall of the horizontal work surface, so that the labels 48 are dispensed substantially on the same plane as the horizontal work surface.

Figure 3:
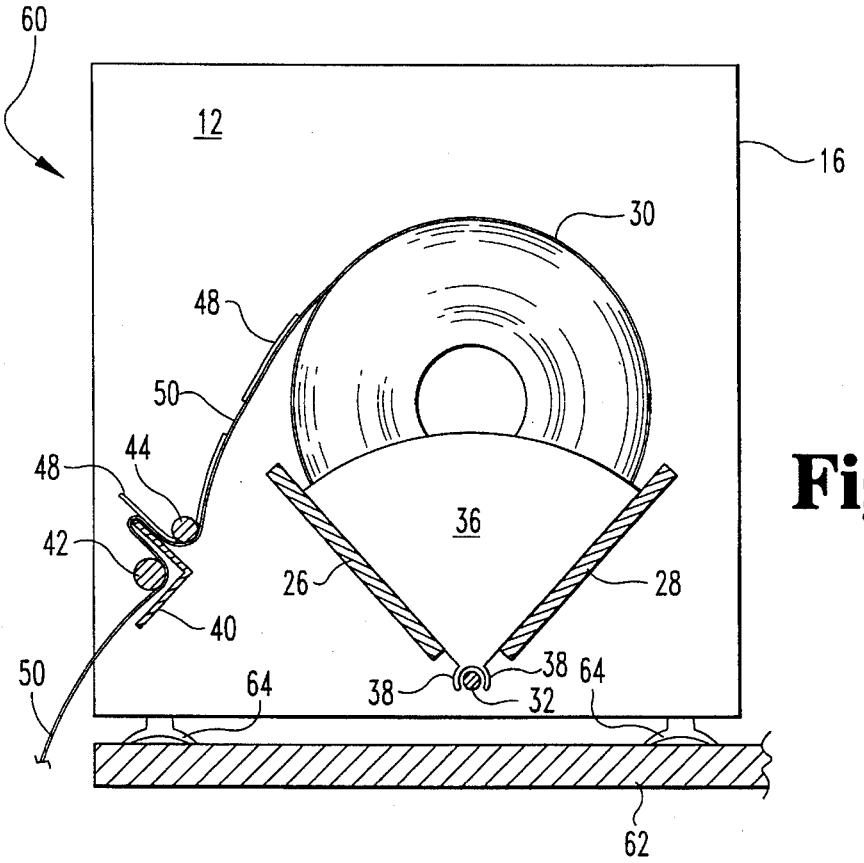
FIG. 3 is a cross-sectional view of a second embodiment of the present invention.

Referring now to FIG. 3, there is illustrated a second embodiment adhesive label dispenser of the present invention, indicated generally at 60. Unlike the first embodiment of the present invention, which was designed to be mounted on a vertical surface, the second preferred embodiment 60 is preferably mounted on a horizontal surface 62. The label dispenser 60 is provided with suction cup feet 64 which releasably secure the label dispenser 60 to the horizontal surface 62. Furthermore, the separating bar 40 and the threading rods 42 and 44 are repositioned to a location near the lower surface of the label dispenser 60. The operation of the label dispenser 60 is equivalent to the operation of the label dispenser 10, however the labels 48 are dispensed near the lower surface of the label dispenser 60, rather than near the upper surface, which is more convenient to the operator when the label dispenser 60 is mounted to the horizontal surface 62. It will be appreciated by those skilled in the art that the positioning of the separating bar 40 and the threading rods 42 and 44 with respect to the end walls 12 and 14 will allow the labels 48 to be dispensed at any desired vertical position.

Figure 4:
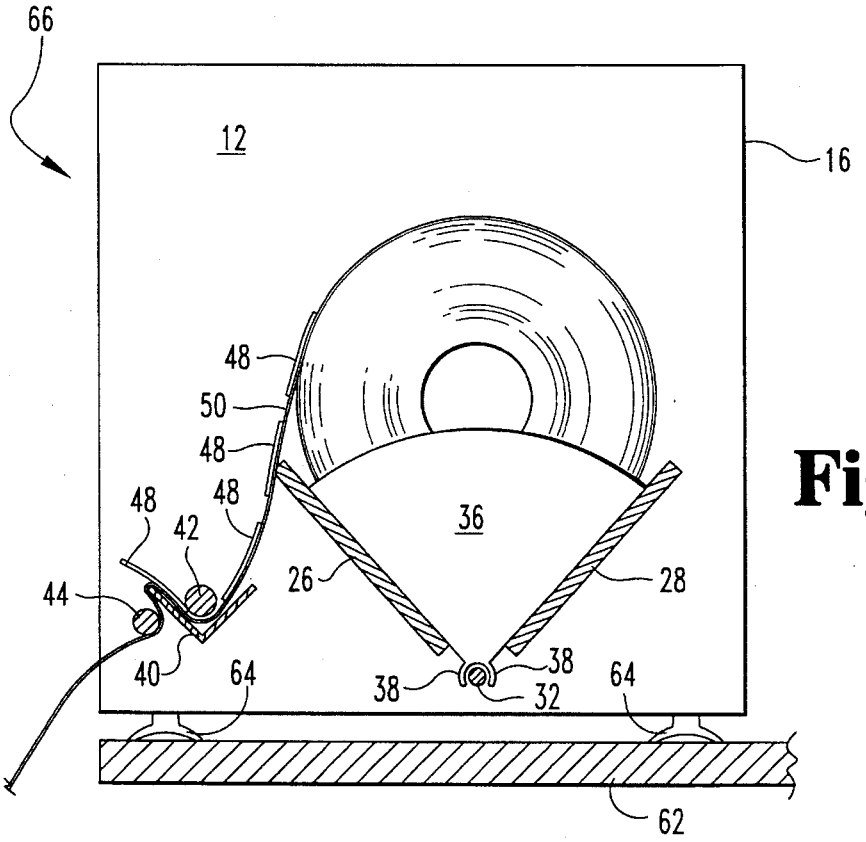
FIG. 4 is a cross-sectional view of a third embodiment of the present invention.

Referring now to FIG. 4, there is illustrated a third embodiment label dispenser of the present invention, indicated generally at 66. The label dispenser 66 is substantially identical to the label dispenser 60, however the orientation of the separating bar 40 and the threading rods 42 and 44 have been rotated by 90°. The effect of such a rotation is to change the angle at which the labels 48 are dispensed when the backing paper 50 is advanced. In the third embodiment of the present invention, the labels 48 are dispensed in a substantially vertical position, which is more appropriate for certain applications. It will be appreciated by those skilled in the art that the separating bar 40 and the threading rods 42 and 44 may be positioned in any desired orientation, such that the labels 48 may be dispensed at any angle with respect to the horizontal.

Figure 5:
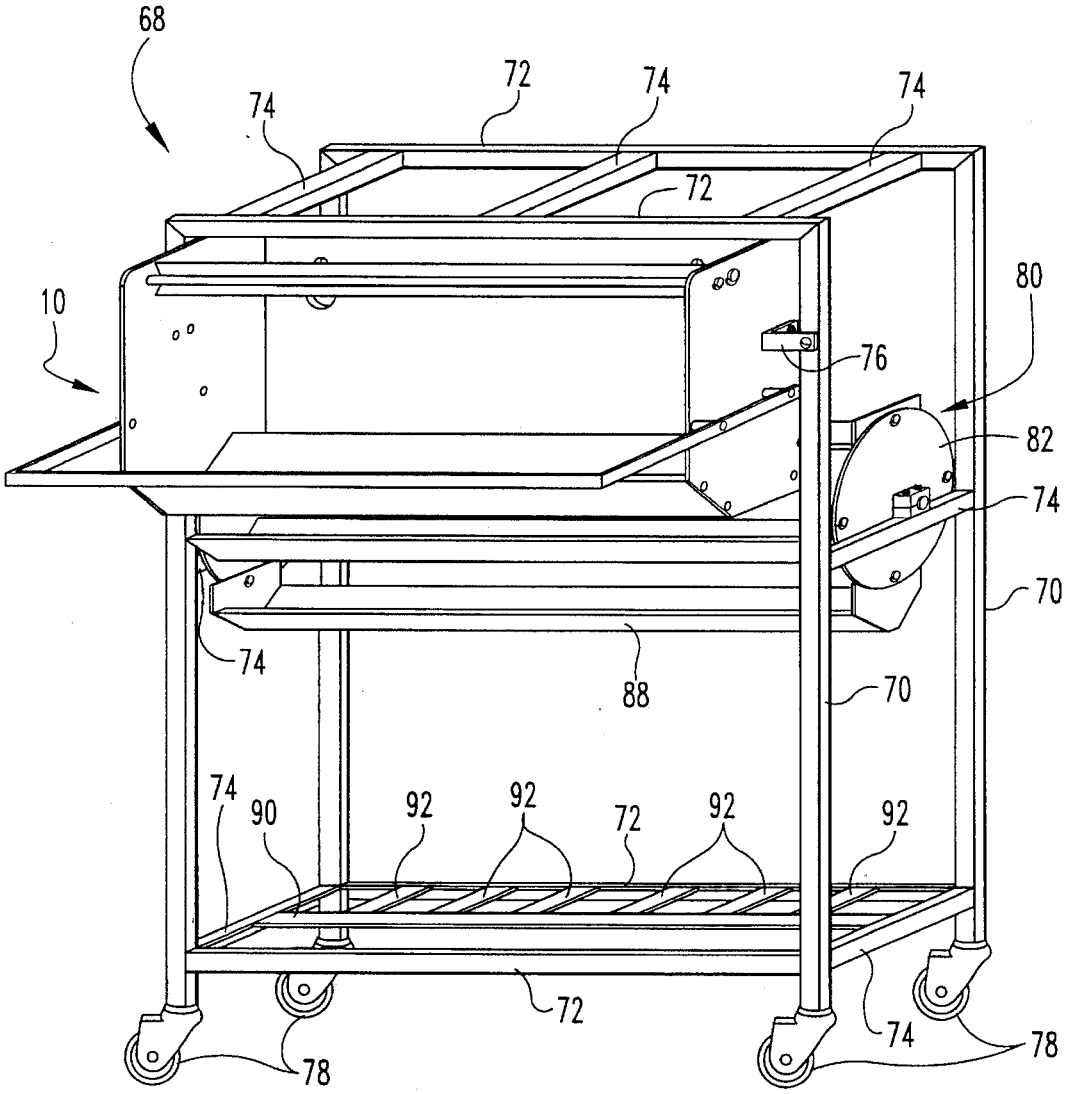
FIG. 5 is a front perspective view of a fourth embodiment of the present invention.
Figure 6:
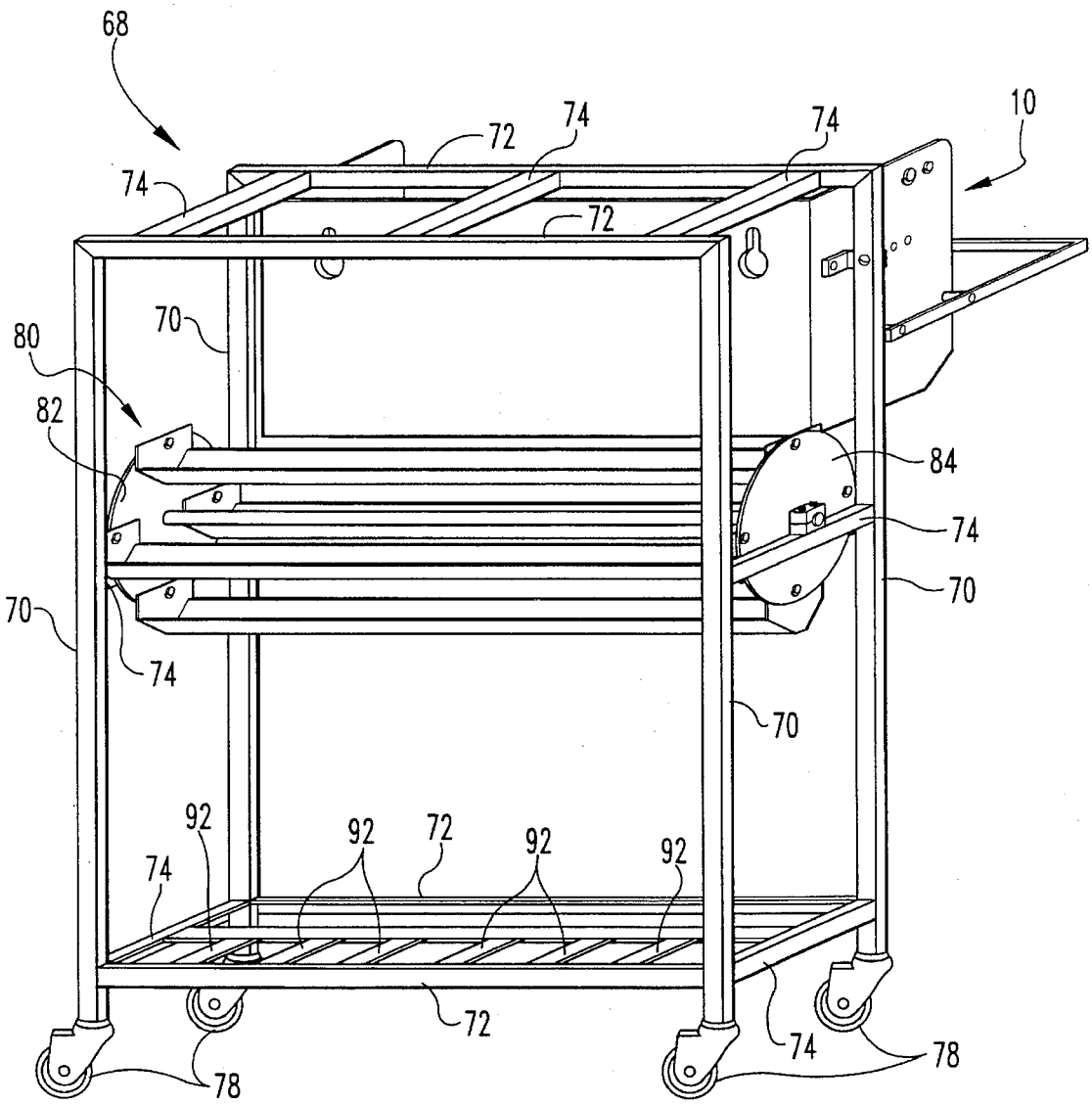
FIG. 6 is a rear perspective view of the fourth embodiment of the present invention.

Referring now to FIGS. 5 and 6, a fourth embodiment adhesive label dispenser cart of the present invention is illustrated and indicated generally at 68. The cart 68 is formed from vertical support members 70, horizontal support members 72 and cross members 74. The upper surface of the cart 68 is intended to be a horizontal work surface. A label dispenser 10 is secured to the front vertical side of the cart 68 by means of L-brackets 76, or by any other convenient means. When so mounted, the label dispenser 10 may be easily utilized while working with items positioned on top of the cart 68, as described hereinabove with reference to FIGS. 1 and 2.

The cart 68 is provided with wheels 78 in order to allow the cart 68 to be moved from place to place. Furthermore, the cart 68 is provided with a revolving storage bin 80. The rotating storage bin 80 includes end pieces 82 and 84, as well as a rod 86 extending therebetween. The rod 86 extends through the end plates 82 and 84 and is rotatably mounted to the cross pieces 74 by any appropriate means. A plurality of trays 88 are mounted between the end plates 82 and 84 around a circumference thereof. The trays 88 are loosely attached to the end plates 82 and 84 so that the trays 88 may rotate about their attachment points. By this construction, the trays 88 will remain upright when the storage bin 80 is rotated, much like the seats of a Ferris wheel. The trays 88 are appropriately sized for storage of the label rolls 30 which are not currently in use in the label dispenser 10. By providing for rotation of the storage bin 80, any of the trays 88 may be advanced to the exterior of the cart 68 for access thereto. This allows for a relatively large number of rolls 30 to be stored in the storage bin 80, while providing equally convenient access to any of the rolls 30.

Further storage for unused rolls is provided near the bottom of the cart 68 by means of the horizontal member 90 and the cross members 92. The relative spacing between the cross members 92 is chosen such that rolls 30 of varying sizes may be conveniently positioned therebetween without falling through. It will be appreciated by those skilled in the art that the cart 68 is a convenient, self-contained work station which may easily be moved to any desired location. The placement of the label dispenser 10 on the cart 68 provides for the labels to be dispensed at the same level as the horizontal work surface. Furthermore, a trash bag 58 may be attached to the members 51–53 of the label dispenser 10, such that the used backing paper 50 of the rolls 30 is automatically deposited within the trash bag 58. Finally, the cart 68 provides for storage of a relatively large number of label rolls 30, which may be conveniently accessed by the operator for installation into the label dispenser 10, as required.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An adhesive label dispenser, comprising:

a first end wall;

a second end wall spaced from the first end wall;

first and second longitudinally extending members positioned between the first and second end walls so as to form a longitudinally extending trough having an open bottom channel, the trough thereby being adapted to hold a plurality of rolls of backing paper which carry adhesive labels thereon;

a longitudinally extending divider rod positioned between the first and second end walls and adjacent to the bottom channel; and at least one divider shaped to fit within the trough when positioned transverse to the trough, the divider including means for slidably engaging the divider rod.

2. The adhesive label dispenser of claim 1, further comprising:

a trash receptacle coupled to the first and second end walls, the trash receptacle having an opening positioned such that the backing paper may be fed into the opening after the labels have been removed therefrom.

3. The adhesive label dispenser of claim 1, further comprising:

a first holding member coupled to the first end wall and extending transverse to the trough;

a second holding member coupled to the second end wall and extending transverse to the trough;

a third holding member coupled to the first and second holding members, the third holding member positioned parallel to the trough and spaced from the trough; and a trash receptacle coupled to the first, second and third holding members, wherein the backing paper may be fed into the trash receptacle after the labels have been removed therefrom.

4. The adhesive label dispenser of claim 2, wherein the trash receptacle is a plastic trash bag.

5. The adhesive label dispenser of claim 1, further comprising:

a first longitudinally extending threading rod positioned between the first and second end walls;

a second longitudinally extending threading rod positioned between the first and second end walls; and a longitudinally extending separating bar having two legs and an L-shaped cross-section, the separating bar positioned between the first and second end walls, wherein the separating bar lies between the first and second threading rods such that the first threading rod is positioned substantially between the legs of the separating bar.

6. The adhesive label dispenser of claim 1, further comprising:

a plurality of suction cup feet coupled to the first and second end walls.

7. An adhesive label dispenser, comprising:

a first end wall;

second end wall spaced from the first end wall;

first and second longitudinally extending members positioned between the first and second end walls so as to form a longitudinally extending trough adapted to hold at least one roll of backing paper which carries adhesive labels thereon;

a first holding member coupled to the first end wall and extending transverse to the trough;

a second holding member coupled to the second end wall and extending transverse to the trough;

a third holding member coupled to the first and second holding members, the third holding member positioned parallel to the trough and spaced from the trough; and wherein a trash receptacle is coupled to the first, second, and third holding members, wherein the backing paper may be fed into the trash receptacle after the labels have been removed therefrom.

8. The adhesive label dispenser of claim 7, wherein the trash receptacle is a plastic trash bag.

9. The adhesive label dispenser of claim 7, further comprising:

an open bottom channel formed in a bottom of the trough between the first and second members;

a longitudinally extending divider rod positioned between the first and second end walls and adjacent to the bottom channel; and at least one divider shaped to fit within the trough when positioned transverse to the trough, the divider including means for slidably engaging the divider rod.

10. The adhesive label dispenser of claim 7, further comprising:

a first longitudinally extending threading rod positioned between the first and second end walls;

a second longitudinally extending threading rod positioned between the first and second end walls; and a longitudinally extending separating bar having two legs and an L-shaped cross-section, the separating bar positioned between the first and second end walls, wherein the separating bar lies between the first and second threading rods such that the first threading rod is positioned substantially between the legs of the separating bar.

11. The adhesive label dispenser of claim 7, further comprising:

a plurality of suction cup feet coupled to the first and second end walls.

12. An adhesive label dispenser, comprising:

a first end wall;

second end wall spaced from the first end wall;

a roll holder positioned between the first and second end walls and adapted to hold at least one roll of backing paper which carries adhesive labels thereon;

a first longitudinally extending threading rod positioned between the first and second end walls;

a second longitudinally extending threading rod positioned between the first and second end walls;

longitudinally extending separating bar having two legs and an L-shaped cross-section, the separating bar positioned between the first and second end walls, wherein the separating bar lies between the first and second threading rods such that the first threading rod is positioned substantially between the legs of the separating bar;

first and second longitudinally extending members positioned between the first and second end wall so as to form a longitudinally extending trough adapted to hold at least one roll of backing paper which carries adhesive labels thereon; and a trash receptacle coupled to the first and second end walls, the trash receptacle having an opening positioned such that the backing paper may be fed into the opening after the labels have been removed therefrom.

13. The adhesive label dispenser of claim 12, further comprising:

a trash receptacle coupled to the first and second end walls, the trash receptacle having an opening positioned such that the backing paper may be fed into the opening after the labels have been removed therefrom.

14. The adhesive label dispenser of claim 13, wherein the trash receptacle is a plastic trash bag.

15. The adhesive label dispenser of claim 12, further comprising:

a first holding member coupled to the first end wall and extending transverse to the trough;

a second holding member coupled to the second end wall and extending transverse to the trough;

a third holding member coupled to the first and second holding members, the third holding member positioned parallel to the trough and spaced from the trough; and a trash receptacle coupled to the first, second and third holding members, wherein the backing paper may be fed into the trash receptacle after the labels have been removed therefrom.

16. The adhesive label dispenser of claim 12, further comprising:

an open bottom channel formed in a bottom of the trough between the first and second members;

a longitudinally extending divider rod positioned between the first and second end walls and adjacent to the bottom channel; and at least one divider shaped to fit within the trough when positioned transverse to the trough, the divider including means for slidably engaging the divider rod.

17. The adhesive label dispenser of claim 12, further comprising:

a plurality of suction cup feet coupled to the first and second end walls.

18. An adhesive label dispenser cart, comprising:

a plurality of vertical support members;

a horizontal work surface supported by the vertical support members;

an adhesive label dispenser coupled to the vertical support members;

a rotating storage bin coupled to the vertical support members, wherein the rotating storage bin includes a plurality of trays; and a plurality of wheels coupled to the vertical support members, wherein the cart is supported by the plurality of wheels such that the cart may be rolled from place to place.

* * * * *

UNITED STATES PATENT AND TRADEMARK OFFICE

CERTIFICATE OF CORRECTION

PATENT NO. : 5,570,809

DATED : November 5, 1996

INVENTOR(S) : Rodger D. Martin

It is certified that error appears in the above-identified patent and that said Letters Patent is hereby corrected as shown below:

In column 2, line 26, "In" should begin a new paragraph.

In column 7, line 37, please insert --a--before "second".

In column 8, line 20, please insert --a-- before "second".

In column 8, line 29, please insert --a-- before "longitudinally".

In column 8, line 38, please change "wall" to --walls--.

Signed and Sealed this

Fourth Day of November, 1997

Bruce Lehman

*Attest:*

BRUCE LEHMAN

*Attesting Officer*

*Commissioner of Patents and Trademarks*